US010281109B2

(12) United States Patent
Lan

(10) Patent No.: US 10,281,109 B2
(45) Date of Patent: May 7, 2019

(54) LED LAMP

(71) Applicant: Shenzhen Guanke Technologies Co., Ltd., Shenzhen (CN)

(72) Inventor: Qing Lan, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 249 days.

(21) Appl. No.: 15/334,324

(22) Filed: Oct. 26, 2016

(65) Prior Publication Data

US 2018/0038572 A1 Feb. 8, 2018

(30) Foreign Application Priority Data

Aug. 4, 2016 (CN) ..... 2016 2 0845614 U
Oct. 13, 2016 (CN) ..... 2016 2 1122091 U

(51) Int. Cl.

| | |
|---|---|
| ***F21V 3/02*** | (2006.01) |
| ***F21V 7/00*** | (2006.01) |
| ***F21V 29/70*** | (2015.01) |
| ***F21K 9/68*** | (2016.01) |
| *F21V 23/00* | (2015.01) |
| *F21V 23/02* | (2006.01) |
| *F21Y 115/10* | (2016.01) |
| *F21V 29/83* | (2015.01) |

(52) U.S. Cl.

CPC ..... *F21V 3/02* (2013.01); *F21K 9/68* (2016.08); *F21V 7/0083* (2013.01); *F21V 29/70* (2015.01); *F21V 23/005* (2013.01); *F21V 23/02* (2013.01); *F21V 29/83* (2015.01); *F21Y 2115/10* (2016.08)

(58) Field of Classification Search

CPC ..... F21V 3/02; F21V 29/70; F21V 7/0083; F21V 29/83; F21V 23/005; F21V 23/02; F21K 9/68; F21Y 2115/10

USPC ..... 362/235

See application file for complete search history.

(56) References Cited

U.S. PATENT DOCUMENTS

2009/0213592 A1* 8/2009 Zhang ..... F21S 8/083 362/249.02
2010/0327725 A1* 12/2010 Huang ..... F21V 7/0025 313/46
2014/0293603 A1* 10/2014 Barnard ..... F21V 29/74 362/241

* cited by examiner

*Primary Examiner* — Anh T Mai
*Assistant Examiner* — Jessica M Apenteng

(57) ABSTRACT

A LED lamp includes a driving member including a driving power, a controlling member including a PCB electrically connected to the driving power, and a light-emitting member. The light-emitting member includes a plurality of light plates having a plurality of light-emitting elements electrically connected to the PCB, and a plurality of reflecting portions. Each of the reflecting portions includes a pair of supporting beams and a plurality of staircase elements straddling the supporting beams. Each of the staircase elements includes a first face connected to one of the supporting beam, a second face connected to another supporting beam, and a third face connecting the first face and the second face. Each of the reflecting portions is mounted to a corresponding light plate and covers the light-emitting elements of the corresponding light plate.

17 Claims, 9 Drawing Sheets

LED LAMP

BACKGROUND

1. Technical Field

The present disclosure generally relates to a LED (light-emitting diode) lamp.

2. Description of Related Art

A conventional LED lamp has the advantages of energy saving, long life, environmental protection and so on. But light source of the LED lamp is very strong, and there is no structure to avoid the light of LED lamp to travel into an upper air, resulting in light pollution in the upper air.

SUMMARY

The disclosure relates to a LED lamp.

In one aspect, a LED lamp includes a a driving member including a driving power, a controlling member including a PCB electrically connected to the driving power, and a light-emitting member. The light-emitting member includes a plurality of light plates having a plurality of light-emitting elements electrically connected to the PCB, and a plurality of reflecting portions. Each of the reflecting portions includes a pair of supporting beams and a plurality of staircase elements straddling the supporting beams. Each of the staircase elements includes a first face connected to one of the supporting beam, a second face connected to another supporting beam, and a third face connecting the first face and the second face. Each of the reflecting portions is mounted to a corresponding light plate and covers the light-emitting elements of the corresponding light plate.

Wherein two adjacent staircase elements is separated by a certain distance.

Wherein one of the staircase elements overlaps another staircase element adjacent to the one of the staircase elements.

Wherein each of the staircase elements defines a first opening positioned in a bottom thereof and a second opening positioned in a side thereof and has a hollow structure, and each of the staircase elements covers a corresponding light-emitting element.

Wherein the driving member includes a lamp head, a firs housing, and a first bottom plate connected to the first housing, wherein the driving power is received in first housing, and the first housing is mounted between the lamp head and the first bottom plate.

Wherein the controlling member includes a connecting cover having a plurality of first dissipating holes and a second housing connected to the connecting cover, wherein the PCB is received in a receiving space surrounding by the second housing and the connecting cover.

Wherein the light-emitting member includes a connecting plate having a plurality of second dissipating holes, a heat sink, and a second bottom plate having a plurality of third dissipating holes, wherein the heat sink defines a plurality of channels in an inner thereof, and cold air gets into the LED lamp from the third dissipating holes, extends through the channels and second dissipating holes, and gets out of the LED lamp from the first dissipating holes.

Wherein the light-emitting member includes a plurality of light-transmitting plates, the heat sink defines a plurality of first grooves for receiving the light plates and a plurality of second grooves for receiving light-transmitting plates.

Each of the light transmitting plate includes a recess portion to cover a corresponding staircase element, and each of the reflecting portions is located between each of the light plates and each of the light-transmitting plates.

In another aspect, a LED lamp includes a controlling member and a light-emitting member. The controlling member includes a PCB, a connecting cover having a plurality of first dissipating holes and a second housing connected to the connecting cover, wherein the PCB is received a receiving space surrounding by the second housing and the connecting cover. The light-emitting member includes a plurality of light plates having a plurality of light-emitting elements electrically connected to the PCB, a plurality of reflecting portions, a connecting plate having a plurality of second dissipating holes, a heat sink, and a second bottom plate having a plurality of third dissipating holes, wherein the heat sink defines a plurality of channels in an inner thereof, and air gets into the LED lamp from the third dissipating holes, extends through the channels and second dissipating holes, and gets out of the LED lamp from the first dissipating holes. Each of the reflecting portions comprising a pair of supporting beams and a plurality of staircase elements straddling the supporting beams, and each of the reflecting portions is mounted to a corresponding light plate and covers the light-emitting elements of the corresponding light plate.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
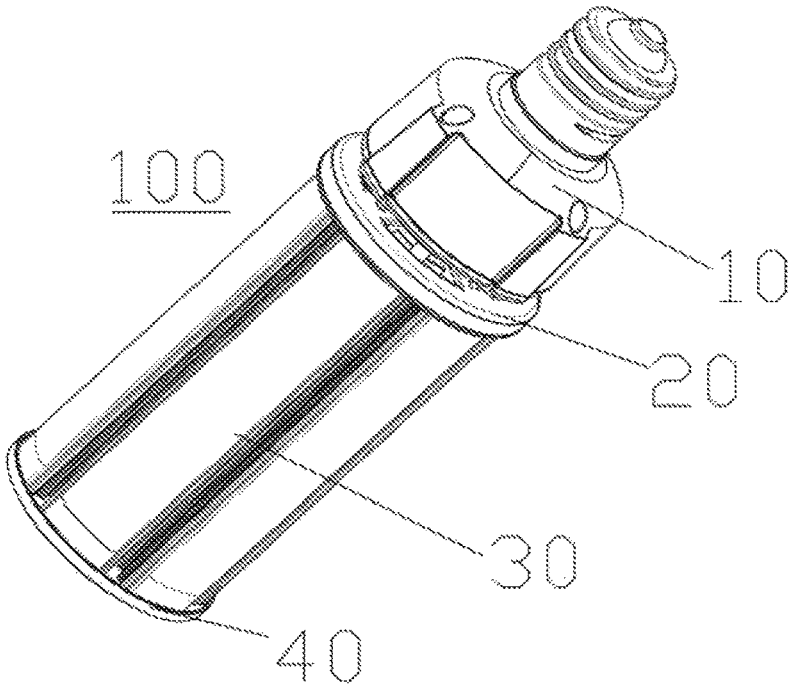
FIG. 1 is an assembled perspective view of a LED lamp in accordance with the present invention.

The disclosure is illustrated by way of example and not by way of limitation in the figures of the accompanying drawings, in which like reference numerals indicate similar elements. The embodiments described in accordance with the drawings are only examples, and thus the claimed invention is not limited thereto.

Referring to FIG. 1, a LED lamp 100 includes a driving member 10, a controlling member 20, and a light-emitting member 30.

Referring to FIG. 2, FIG. 7, FIG. 10 and FIG. 11, the driving member 10 includes a driving power 101. The controlling member 20 includes a PCB 21 electrically connected to the driving power 101. The light-emitting member 30 includes a plurality of light plates 31 having a plurality of light-emitting elements 312 electrically connected to the PCB 21, and a plurality of reflecting portions 32. Each of the reflecting portions 32 is mounted to a corresponding light plate 31 and covers the light-emitting elements 312 of the corresponding light plate 31. Each of the reflecting portions 32 includes a pair of supporting beams 321 and a plurality of staircase elements 322 straddling the supporting beams 321. Each of the staircase elements 322 includes a first face 3221 connected to one of the supporting beam 321, a second face 3222 connected to another supporting beam 321, and a third face 3223 connecting the first face 3221 and the second face 3222.

In one embodiment, the light-emitting member 30 includes six light plates 31, and six reflecting portions 32.

In one embodiment, a structure of the first face 3221 is the same as a structure of the second face 3222, for example a triangle. In another embodiment, the structure of the first face 3221 is different from the structure of the second face 3222.

In one embodiment, the third face 3223 is a quadrilater.

Figure 12:
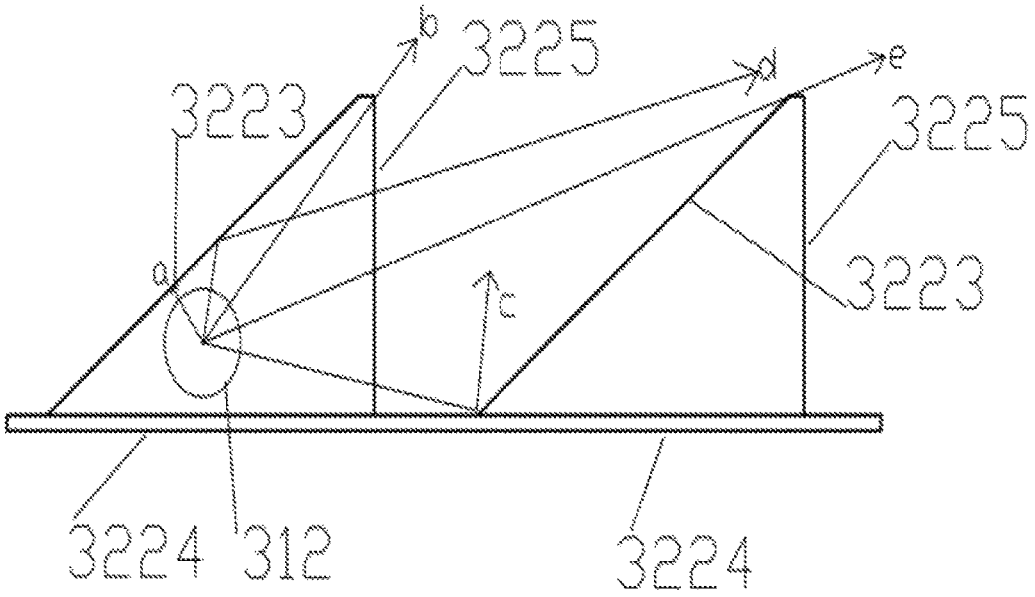
FIG. 12 is a schematic diagram of the light reflecting in a third face of a staircase element of the reflecting portion of FIG. 11 in accordance with a first embodiment.
Figure 13:
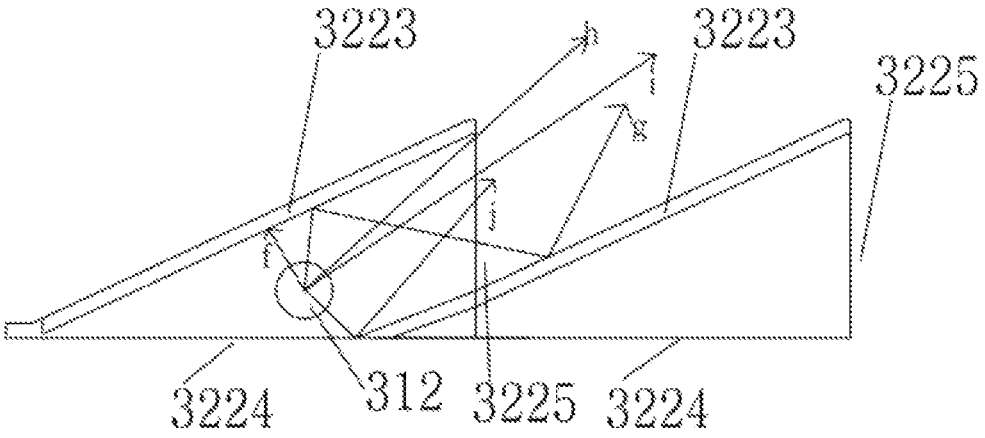
FIG. 13 is a schematic diagram of the light reflecting in a third face of a staircase element of the reflecting portion of FIG. 11 in accordance with a second embodiment.
Figure 14:
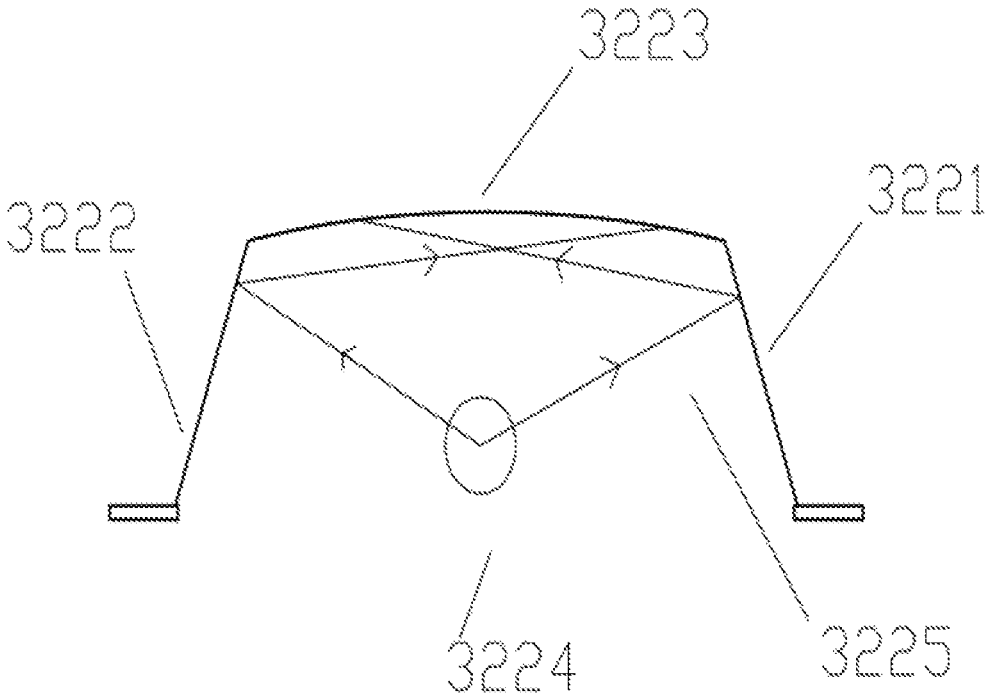
FIG. 14 is a schematic diagram of the light reflecting in a first face and a second face of a staircase element of the reflecting portion of FIG. 11.

In use, referring to FIG. 12 showing a light reflecting in the reflecting portion 32 in accordance with a first embodiment, any one of the light-emitting elements 312 generates light a, light b, light c, light d, and light e. Light within an area between the light a and the light b, for example, light d is reflected by the third face 3223, and light d is emitted from a second opening 3225 of the staircase element 322; light within an area between the light b and the light e is directly emitted from the second opening 3225; Light within an area between the light e and the light c is emitted from the second opening 3225, and is reflected by a adjacent third face 3223. Referring to FIG. 13 showing a light reflecting in the reflecting portion 32 in accordance with a second embodiment, any one of the light-emitting elements 312 generates light f, light g, light h, light i, and light j. Light within an area between the light f and the light h, for example, light g is reflected by the third face 3223, and light g is emitted from a second opening 3225 of the staircase element 322; light within an area between the light h and the light j, for example, light i is directly emitted from the second opening 3225, or emitted from the second opening 3225 and is reflected by a adjacent third face 3223. Referring to FIG. 14, light generated by any one of the light-emitting element 312 is reflected by the first face 3221 and the second face 322 to the third face 3223, for example, light d, and is emitted from the second opening 3225. That is to say, after the light generated by each of the light-emitting elements 312 reflects within a corresponding staircase element 322, direction of the light is adjusted, so that the light generated by each of the light-emitting elements 312 is emitted from the second opening 3225 of the corresponding staircase element 322, thereby controlling angle of illumination of the light. In the embodiment, the second opening departs from a lamp head 102, the light generated by the light-emitting elements 312 is emitted away from the lamp head 102, thereby reducing pollution of the light in an upper air. Furthermore, the light is emitted from the second opening 3225, i.e. the light is completely emitted away from the lamp head 102, thereby improving utilization ratio and brightness of the light, and inducing the energy consumption.

Figure 11:
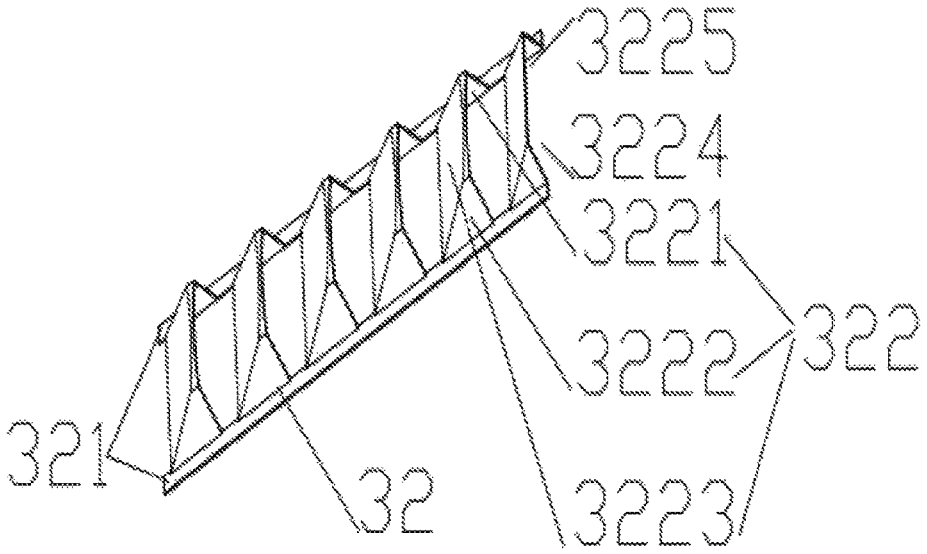
FIG. 11 is a perspective view of a reflecting portion of the LED lamp of FIG. 1.

Referring to FIG. 11, FIG. 12, and FIG. 14, in one embodiment, two adjacent staircase elements 322 is separated by a certain distance.

Referring to FIG. 11, FIG. 13, and FIG. 14, in another embodiment, one of the staircase elements 322 overlaps another staircase element 322 adjacent to the one of the staircase elements 322.

Each of the staircase elements 322 defines a first opening 3224 positioned a bottom thereof and the second opening 3225 positioned a side thereof and has a hollow structure, and each of the staircase elements 322 covers a corresponding light-emitting element 312. In one embodiment, each of the light-emitting elements 312 is received in a corresponding staircase element 322, so that the light from each of the staircase elements 322 can completely reflect within the corresponding staircase element 322, and cannot travel into an upper air from a gap between the two adjacent staircase elements 322, thereby reducing the pollution of light in the upper air.

In another embodiment, each of the light-emitting elements 312 is not received in an inner of a corresponding staircase element 322, as long as each of the staircase elements 322 can completely cover the light from a corresponding light-emitting element 312.

Figure 2:
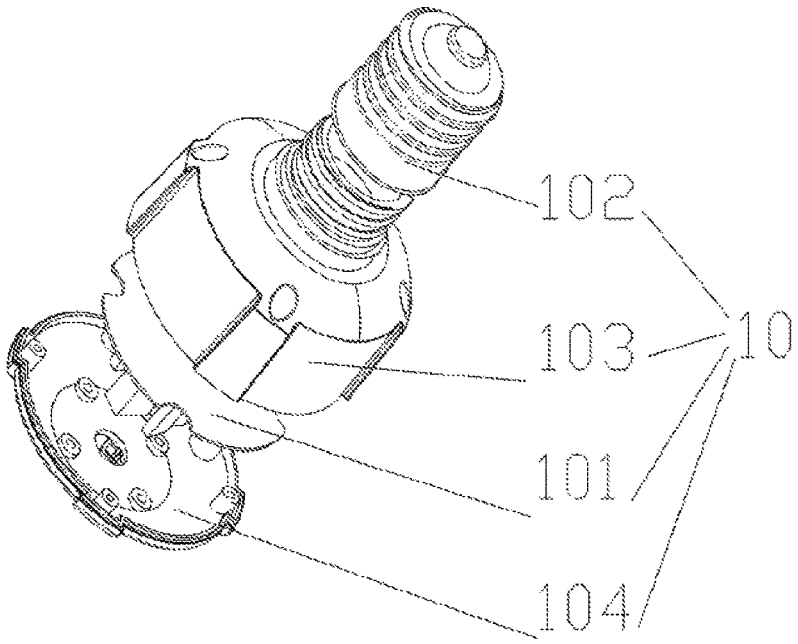
FIG. 2 is an assembled perspective view of a driving member of the LED lamp of FIG. 1.
Figure 3:
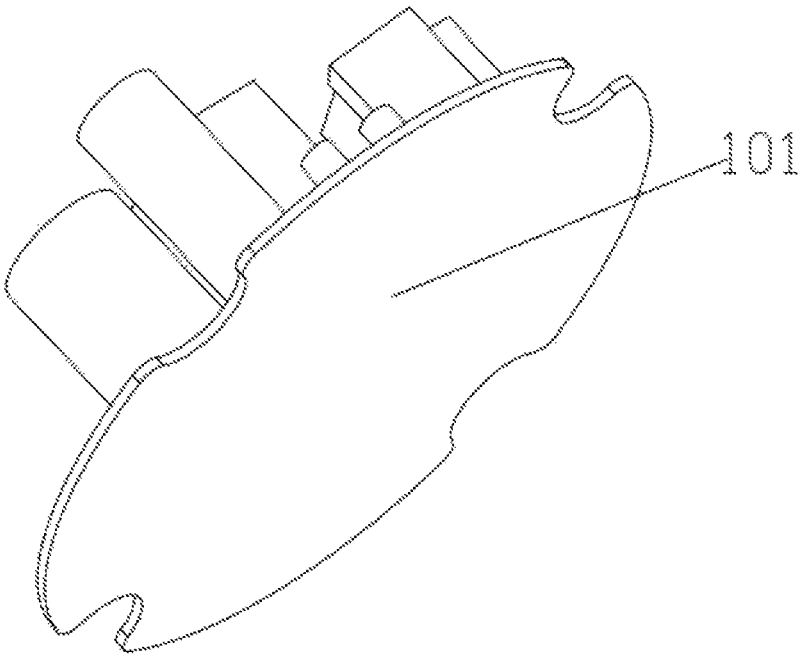
FIG. 3 is a perspective view of a driving power of the driving member of FIG. 2.
Figure 4:
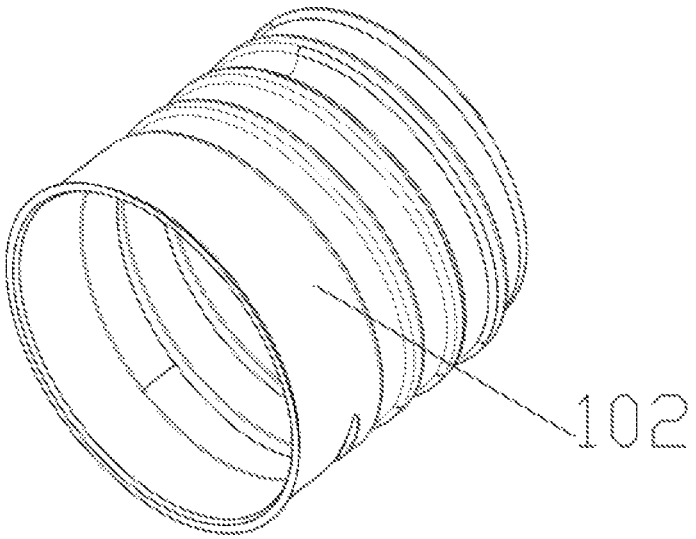
FIG. 4 is a perspective view of a lamp head of the driving member of FIG. 2.
Figure 5:
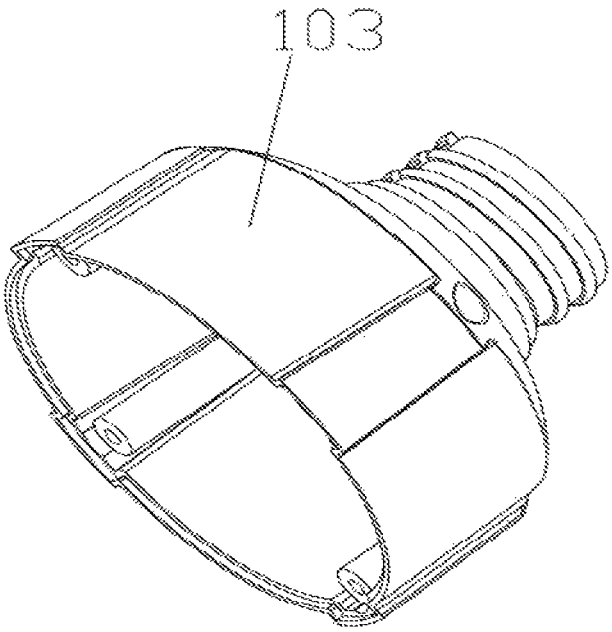
FIG. 5 is a perspective view of a first housing of the LED lamp of FIG. 1.
Figure 6:
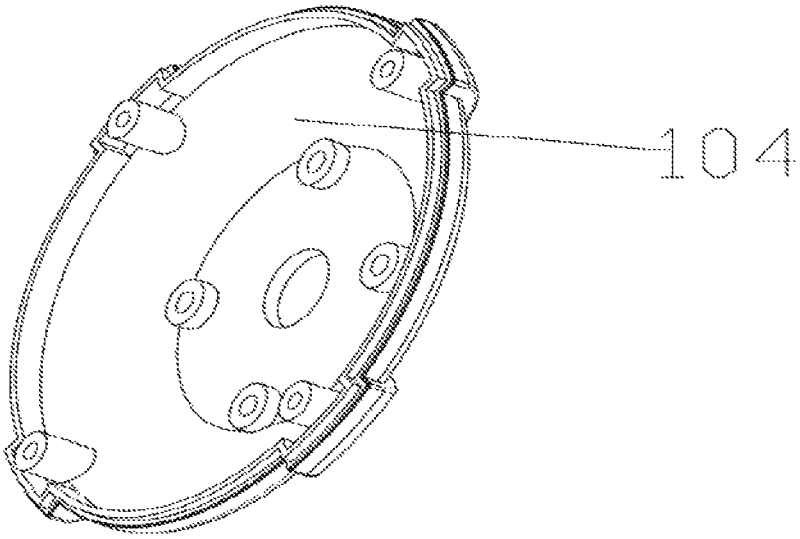
FIG. 6 is a perspective view of a first bottom plate of the LED lamp of FIG. 1.
Figure 7:
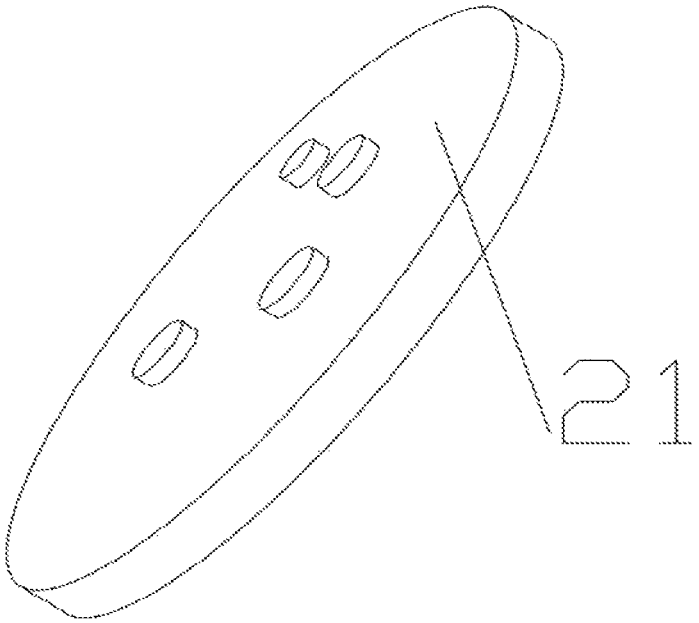
FIG. 7 is a perspective view of a PCB of the LED lamp of FIG. 1.

Referring to FIG. 2, the driving member 10 includes the lamp head 102, a firs housing 103, and a first bottom plate 104 connected to the first housing 103. The driving power 101 is received in first housing 103, and the first housing 103 is mounted between the lamp head 102 and the first bottom plate 104.

Figure 8:
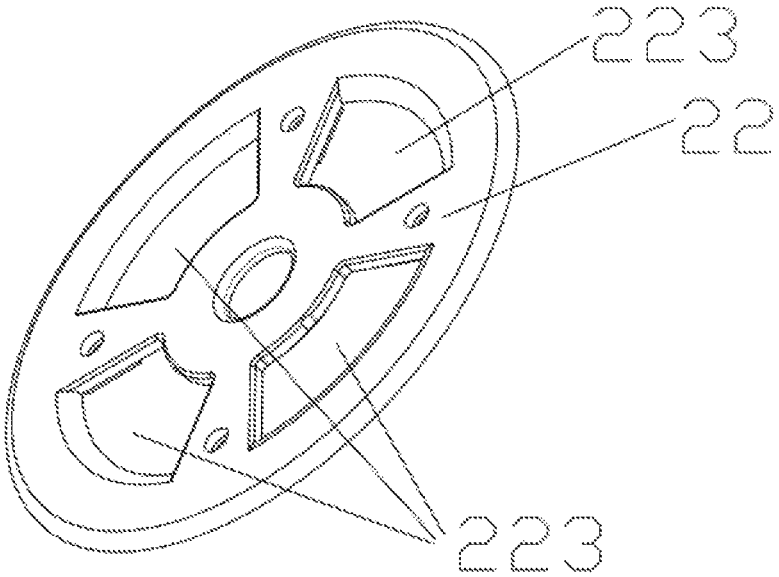
FIG. 8 is a perspective view of a connecting cover of the LED lamp of FIG. 1.
Figure 9:
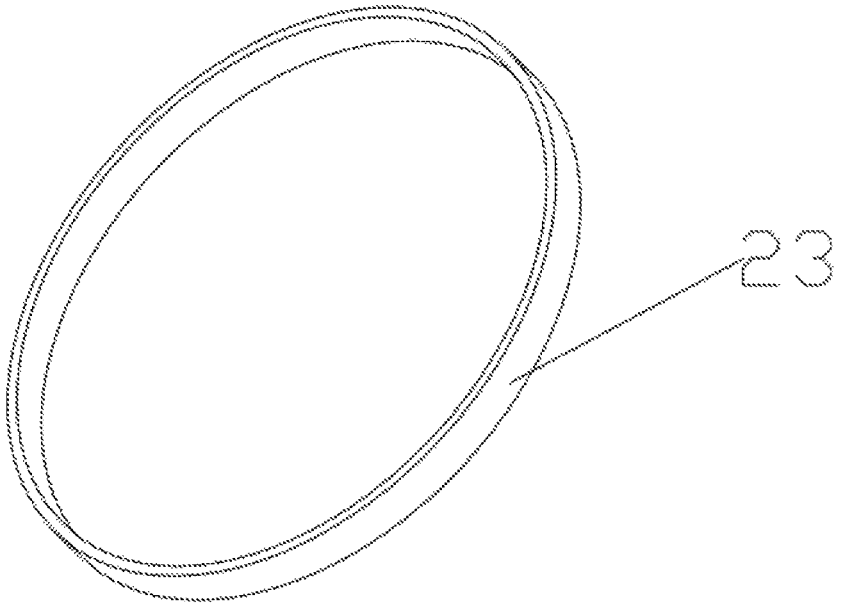
FIG. 9 is a perspective view of a second housing of the LED lamp of FIG. 1.
Figure 10:
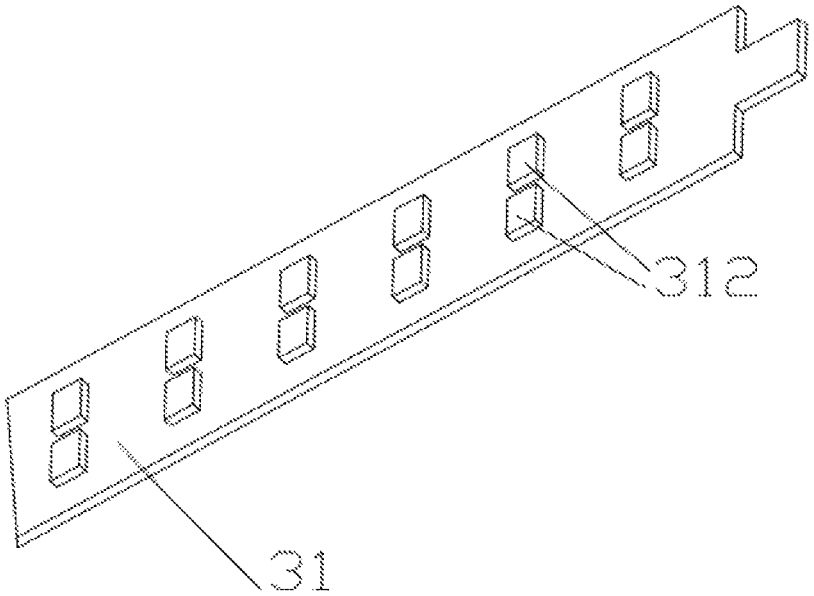
FIG. 10 is a perspective view of a light plate of the LED lamp of FIG. 1.

Referring to FIG. 8 and FIG. 9, the controlling member 20 includes a connecting cover 22 having a plurality of first dissipating holes 223 and a second housing 23 connected to the connecting cover 22. The PCB 21 is received a receiving space surrounding by the second housing 23 and the connecting cover 22.

Figure 17:
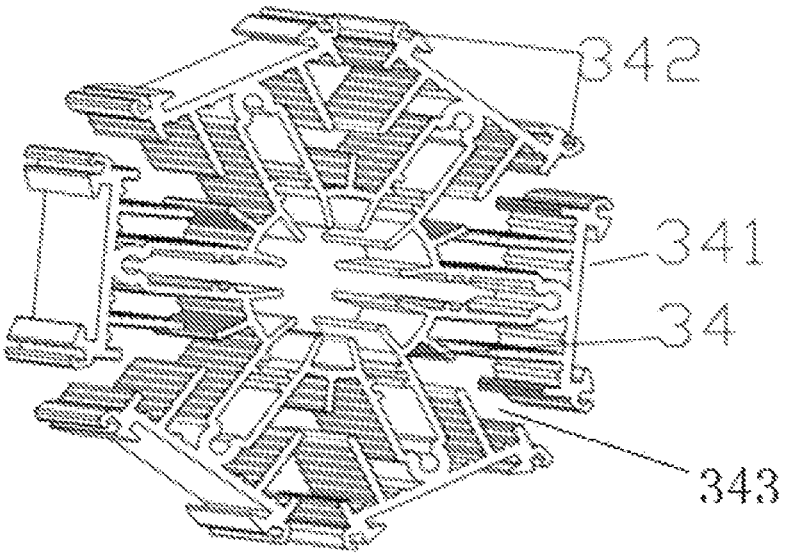
FIG. 17 is a perspective view of a heat sink of the LED lamp of FIG. 1.
Figure 18:
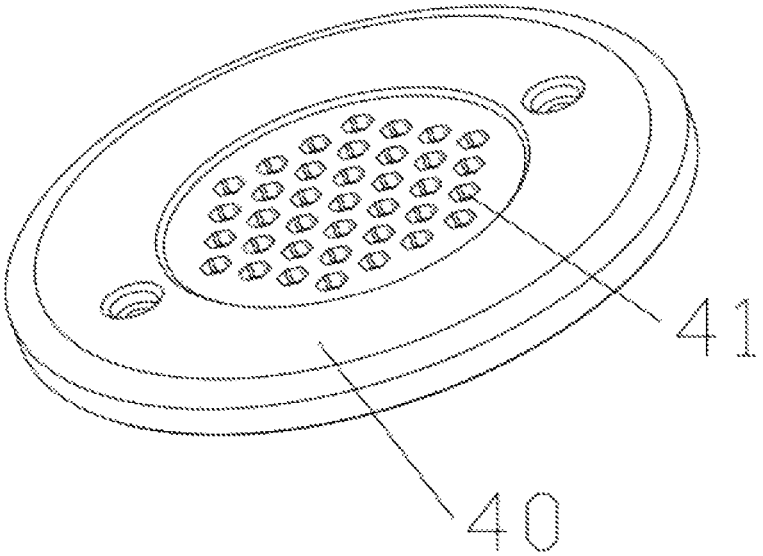
FIG. 18 is a perspective view of a second bottom plate of the LED lamp of FIG. 1.

Referring to 16, FIG. 17, and FIG. 18, the light-emitting member 30 includes a connecting plate 33 having a plurality of second dissipating holes 333, a heat sink 34, and a second bottom plate 40 having a plurality of third dissipating holes 41. The heat sink 34 defines a plurality of channels 343 in an inner thereof. In use, cold air gets into the LED lamp 100 from the third dissipating holes 41, extends through the channels 343 and second dissipating holes 333, and gets out of the LED lamp 100 from the first dissipating holes 223. That is to say, the third dissipating holes 41 is air inlet, the channels 343 and second dissipating holes 333 is convection channels, and the first dissipating holes 223 is air outlet.

In one embodiment, the second bottom plate 40 is next to one end of the heat sink 34, the connecting plate 33 is next to another end of the heat sink 34, and the first dissipating holes 223, the second dissipating holes 333, the third dissipating holes 41, and the channels 343 of the heat sink 34 are in communication with each other.

The air inlet is located in the one end of the heat sink 34, and the air outlet is located in the another end of the heat sink 34, and the channels 343 of the heat sink 34 communication with the air inlet and the air outlet, so that cool air get into the heat sink 34 from the air inlet, extends though the heat sink 34, and gets out of the LED lamp 100 from the first dissipating holes 223 to dissipate heat generated by the heat sink 34, thereby increasing heat dissipation effect of the heat sink 34.

The controlling member 20 is positioned between the driving member 10 and the light-emitting member 30 to separate the driving power 101 from the heat sink 34 to avoid the heat generated by the heat sink 34 to damage the driving power 101, thereby increasing work efficiency and prolonging service life of the LED lamp 100.

Figure 15:
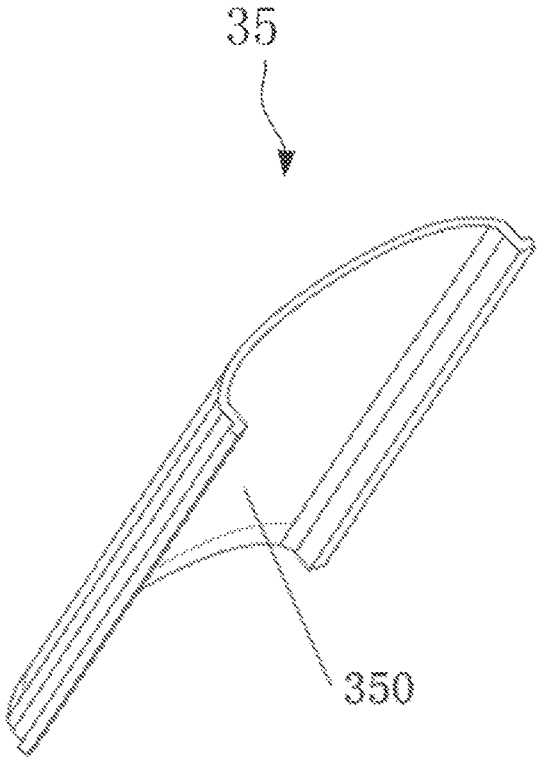
FIG. 15 is a perspective view of a light-transmitting plate of the LED lamp of FIG. 1.
Figure 16:
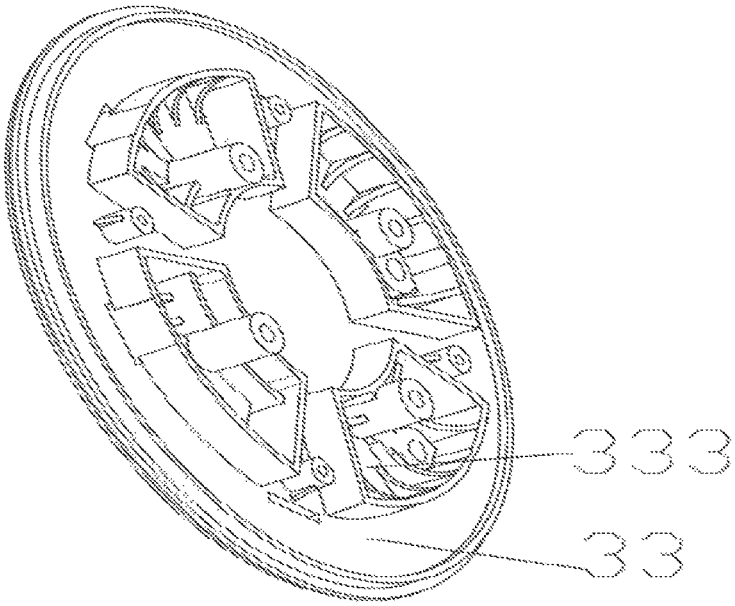
FIG. 16 is a perspective view of a connecting plate of the LED lamp of FIG. 1.

Referring to FIG. 15 and FIG. 17, the light-emitting member 30 includes a plurality of light-transmitting plates 35. The heat sink 34 defines a plurality of first grooves 341 for receiving the light plates 31 and a plurality of second grooves 342 for receiving light-transmitting plates 35.

In one embodiment, the heat sink 34 defines six first grooves 341 and six second grooves 342.

In one embodiment, the light-emitting member 30 includes six light-transmitting plates 35.

In one embodiment, each of the light transmitting plate 35 defines a recess portion 350 to cover a corresponding staircase element 322, and each of the reflecting portions 32 is located between each of the light plates 31 and each of the light-transmitting plates 35.

Referring to FIG. 1 to FIG. 18, in assemble, the driving power 101 is received in the first housing 103, and the first housing 103 is mounted between the lamp head 102 and the first bottom plate 104, so that the driving power 101, the lamp head 102, first housing 103, and the first bottom plate 104 are assembled into the driving member 10. The PCB 21 is received in the receiving space surrounding by the second housing 23 and the connecting cover 22, so that the PCB 21, the connecting cover 22, and the second housing 23 are assembled into the controlling member 20. Each of the reflecting portions 32 fitting with the each of the light plates 31 are received in a corresponding the first grooves 341, and each of the light-transmitting plates 35 are received in a corresponding second grooves 342, so that the light plates 31, the reflecting portions 32, the connecting plate 33, the heat sink 34, and the second bottom plate 40 are assembled into the light-emitting member 30. Thus, the driving member 10, the controlling member 20, and the light-emitting member 30 are assembled into the LED lamp 100.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A light-emitting diode (LED) lamp, comprising:

a driving member comprising a driving power;

a controlling member comprising a PCB electrically connected to the driving power; and a light-emitting member comprising a plurality of light plates having a plurality of light-emitting elements electrically connected to the PCB, and a plurality of reflecting portions, each of the reflecting portions comprising a pair of supporting beams and a plurality of staircase elements straddling the supporting beams, each of the staircase elements comprising a first face connected to one of the supporting beam, a second face connected to another supporting beam, and a third face connecting the first face to the second face;

wherein each of the reflecting portions is mounted to a corresponding light plate and covers the light-emitting elements of the corresponding light plate.

2. The LED lamp of claim 1, wherein two adjacent staircase elements are separated by a certain distance.

3. The LED lamp of claim 1, wherein one of the staircase elements overlaps another staircase element adjacent to the one of the staircase elements.

4. The LED lamp of claim 1, wherein each of the staircase elements defines a first opening positioned in a bottom thereof and a second opening positioned in a side thereof and has a hollow structure, and each of the staircase elements covers a corresponding light-emitting element.

5. The LED lamp of claim 1, wherein the driving member comprises a lamp head, a first housing, and a first bottom plate connected to the first housing, wherein the driving power is received in first housing, and the first housing is mounted between the lamp head and the first bottom plate.

6. The LED lamp of claim 1, wherein the controlling member comprises a connecting cover having a plurality of first dissipating holes and a second housing connected to the connecting cover, wherein the PCB is received in a receiving space surrounding by the second housing and the connecting cover.

7. The LED lamp of claim 6, wherein the light-emitting member comprises a connecting plate having a plurality of second dissipating holes, a heat sink, and a second bottom plate having a plurality of third dissipating holes, wherein the heat sink defines a plurality of channels in an inner thereof, and air gets into the LED lamp from the third dissipating holes, extends through the channels and second dissipating holes, and gets out of the LED lamp from the first dissipating holes.

8. The LED lamp of claim 7, wherein the light-emitting member comprises a plurality of light-transmitting plates, the heat sink defines a plurality of first grooves for receiving the light plates and a plurality of second grooves for receiving light-transmitting plates.

9. The LED lamp of claim 8, wherein each of the light transmitting plate comprises a recess portion to cover a corresponding staircase element, and each of the reflecting portions is located between each of the light plates and each of the light-transmitting plates.

10. A LED lamp comprising:

a controlling member comprising a PCB, a connecting cover having a plurality of first dissipating holes and a second housing connected to the connecting cover, wherein the PCB is received in a receiving space surrounding by the second housing and the connecting cover; and a light-emitting member comprising a plurality of light plates having a plurality of light-emitting elements electrically connected to the PCB, a plurality of reflecting portions, a connecting plate having a plurality of second dissipating holes, a heat sink, and a second bottom plate having a plurality of third dissipating holes, wherein the heat sink defines a plurality of channels in an inner thereof, and air gets into the LED lamp from the third dissipating holes, extends through the channels and second dissipating holes, and gets out of the LED lamp from the first dissipating holes;

wherein each of the reflecting portions comprising a pair of supporting beams and a plurality of staircase elements straddling the supporting beams, and each of the reflecting portions is mounted to a corresponding light plate and covers the light-emitting elements of the corresponding light plate.

11. The LED lamp of claim 10, wherein each of the staircase elements comprising a first face connected to one of the supporting beams, a second face connected to another supporting beam, and a third face connecting the first face to the second face.

12. The LED lamp of claim 10, therein two adjacent staircase elements are separated by a certain distance.

13. The LED lamp of claim 10, wherein one of the staircase elements overlaps another staircase element adjacent to the one of the staircase elements.

14. The LED lamp of claim 10, wherein each of the staircase elements defines a first opening positioned in a bottom thereof and a second opening positioned in a side thereof and has a hollow structure, and each of the staircase elements covers a corresponding light-emitting element.

15. The LED lamp of claim 10, wherein the LED lamp comprises a driving member, the driving member comprises a driving power, a lamp head, a first housing, and a first bottom plate connected to the first housing, wherein the driving power is received in first housing, and the first housing is mounted between the lamp head and the first bottom plate.

16. The LED lamp of claim 10, wherein the light-emitting member comprises a plurality of light-transmitting plates, the heat sink defines a plurality of first grooves for receiving the light plates and a plurality of second grooves for receiving light-transmitting plates.

17. The LED lamp of claim 16, wherein each of the light transmitting plate comprises a recess portion to cover a corresponding staircase element, and each of the reflecting portions is located between each of the light plates and each of the light-transmitting plates.

* * * * *